US006456014B1

(12) United States Patent
Ono et al.

(10) Patent No.: US 6,456,014 B1
(45) Date of Patent: Sep. 24, 2002

(54) FIELD EMISSION DEVICE

(75) Inventors: Tomio Ono; Tadashi Sakai, both of Yokohama; Li Zhang, Inagi, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 251 days.

(21) Appl. No.: 09/606,013

(22) Filed: Jun. 29, 2000

(30) Foreign Application Priority Data

Jun. 30, 1999 (JP) ..... 11-186548

(51) Int. Cl.[7] ..... G09G 3/10
(52) U.S. Cl. ..... 315/169.3; 313/310
(58) Field of Search ..... 315/169.1, 169.2, 315/169.3, 169.4; 313/310, 312, 495

(56) References Cited

U.S. PATENT DOCUMENTS

| | | | | |
|---|---|---|---|---|
| 5,828,163 A | * | 10/1998 | Jones et al. | 313/336 |
| 5,834,900 A | * | 11/1998 | Tanaka et al. | 315/169.1 |
| 5,898,258 A | | 4/1999 | Sakai et al. | 313/309 |
| 6,057,636 A | * | 5/2000 | Sakai et al. | 313/306 |
| 6,103,133 A | | 8/2000 | Sakuma et al. | 216/11 |
| 6,153,978 A | * | 11/2000 | Okamoto | 315/169.3 |
| 6,362,574 B1 | * | 3/2002 | Aguero et al. | 315/169.3 |

FOREIGN PATENT DOCUMENTS

| | | |
|---|---|---|
| JP | 8-064111 | 3/1996 |
| JP | 9-185941 | 7/1997 |
| JP | 9-259744 | 10/1997 |

OTHER PUBLICATIONS

C.A. Spindt, et al., Journal of Applied Physics, vol. 47, No. 12, pp. 5248–5263, "Physical Properties of Thin–Film Field Emission Cathodes with Molybdenum Cones," Dec. 1976.

S. Fukuta, et al., The Japan Society of Applied Physics (The 54$^{th}$ Autumn Meeting), No. 2, p. 544, Abstract No. 27p–Y–9, "Improvements in Emission Uniformity and Redundancy of FEAs," 1993 (Abstract Only).

A. Ting, et al., Technical Digest of IVMC, pp. 200–201, "Field–Effect Controlled Vacuum Field–Emission Cathodes," 1991.

* cited by examiner

*Primary Examiner*—Don Wong
*Assistant Examiner*—Minh D A
(74) *Attorney, Agent, or Firm*—Oblon, Spivak, McClelland, Maier & Neustadt, P.C.

(57) ABSTRACT

A field emission device comprises an anode plate, an emitter plate having a plurality of filed emission portions that face the anode plate, and a gate plate having openings corresponding to the filed emission portions. The field emission device also comprises a current limiting element composed of a J FET or a MOSFET that is integrally formed with the gate plate and that is inserted between the gate plate and a gate voltage supply terminal. The loss caused by the emitter current is small as the current limiting element is inserted into a gate input portion. If the field emission device including a number of blocks each having the above structure is constituted, a power switching device having sufficient redundancy against a short circuit between the gate and the emitter can be implemented.

22 Claims, 8 Drawing Sheets

FIG. 2A
PRIOR ART
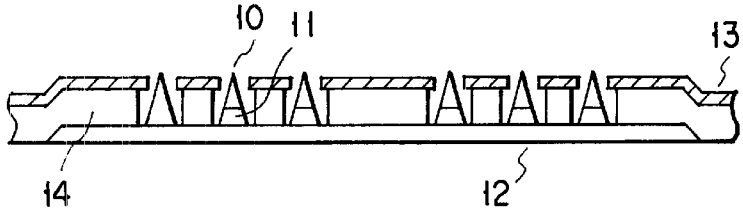
FIG. 2B
PRIOR ART
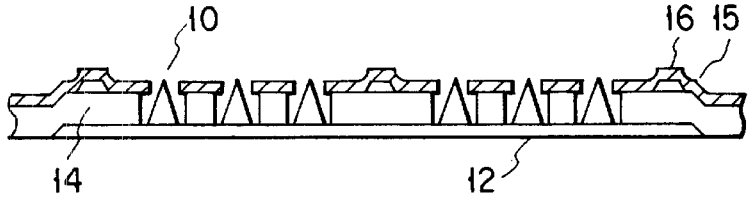
FIG. 2C
PRIOR ART
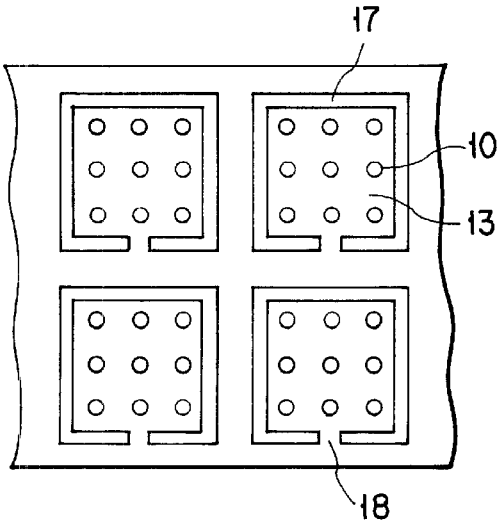
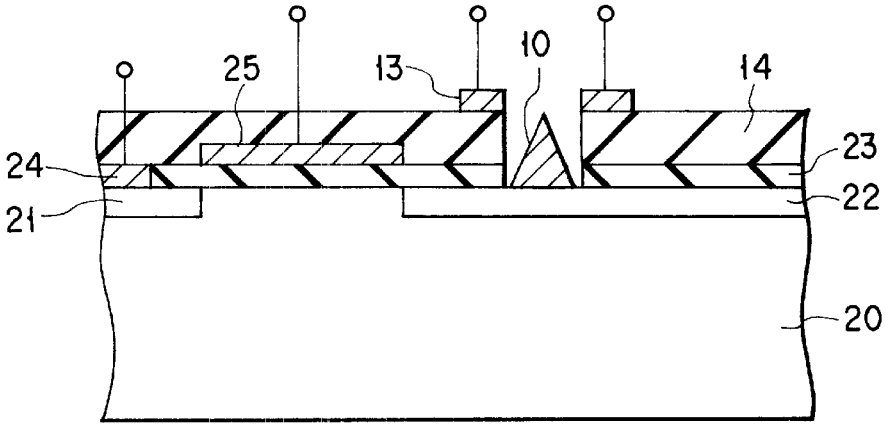
FIG. 3 PRIOR ART

FIELD EMISSION DEVICE

CROSS-REFERENCE TO RELATED APPLICATIONS

This application is based upon and claims the benefit of priority from the prior Japanese Patent Application No. 11-186548, filed Jun. 30, 1999, the entire contents of which are incorporated herein by reference.

BACKGROUND OF THE INVENTION

The present invention relates to a field emission device comprising means for limiting the current at the time of occurrence of a short circuit between the emitter and the gate.

Recently, the field emission device of the field emission type that is as small as the semiconductor device has been developed by use of the developed Si-semiconductor micromachining technique, and the application of the field emission device to a flat panel display and the like has been promoted. The report of C. A. Spindt et al. (Journal of Applied Physics, vol. 47, 5249, 1976) is known as a typical example of it.

As for the field emission device described in this report, as shown in FIGS. 1A to 1D, an $SiO_2$ layer 2 is formed as an insulation layer on an Si-monocrystalline substrate 1 by thermal oxidation. After an Mo layer 3 that is to be a gate electrode is formed by vacuum evaporation, a hole 4 is formed by etching (FIG. 1A). Then, Al is deposited by vacuum evaporation in the oblique direction while rotating the Si-monocrystalline substrate 1, and an Al layer 5 is thereby formed (FIG. 1B).

Next, Mo that is to be an emitter is deposited by vacuum evaporation on the Si-monocrystalline substrate 1 in the vertical direction, and Mo is stacked in a conical shape inside the hole 4 by taking advantage of the fact that the hole 4 becomes closed as a Mo layer 6 is stacked (FIG. 1C). Finally, a conical emitter 7 is formed by removing the Al layer 5 and the Mo layer 6 (FIG. 1D).

A resultant structure is held face to face with an anode (not shown) in a vacuum vessel so as to be the field emission device.

This field emission device applies the positive voltage to the gate to generate a large electric field at the tip of the emitter, and the electrons extracted from the interior of the emitter into the vacuum is collected by the anode (not shown). Actually, the field emission device has an array structure comprising many emitters to obtain a large current. However, as a large number of emitters are connected in parallel, there is a serious problem that the overall array cannot be operated if one emitter causes a short circuit with the gate. Thus the redundancy in a short circuit between the emitter and the gate needs to be improved.

To solve this problem, the device having the structure proposed in Extended Abstracts (The 54th Autumn Meeting, 1993): The Japan Society of Applied Physics 27P-Y-9. The structure of the device is shown in FIGS. 2A to 2C. In the device shown in FIG. 2A, a lower part of an emitter 10 is formed by a high resistance layer 11. In FIG. 2B, a gate potential is supplied to the high resistance gate 15. In either case, when a short circuit occurs between the gate and the emitter, most of the voltage is applied to the high resistance portion and the overall device is prevented from becoming inoperable to maintain the redundancy.

In the device of FIG. 2C, the array is divided into blocks 17 and the gate potential is supplied to the gate of each block through a fuse 18. When a short circuit occurs, the fuse is melted to electrically separate the blocks and the redundancy is thereby maintained.

A device having the structure as described in the Technical Digest of IVMC, 91, p. 200, 1991 is also proposed. The structure is illustrated in FIG. 3.

After an n-type source region 21 and an n-type drain region 22 are formed on a p-type Si-substrate 20, a thermally oxidized $SiO_2$ layer 23 is formed. Next, an emitter is formed in the above-explained manner in a drain region of a MOSFET produced by forming a source electrode 24 and a gate electrode 25. In this device a current flowing in the emitter can be controlled by the MOSFET inserted at the emitter side. For this reason, a current flowing at the occurrence of a short circuit between the emitter and the gate is limited by the FET and the redundancy can be therefore maintained.

However, there is a serious problem in the above-described conventional method as explained below.

First, according to the method of limiting a current at the occurrence of a short circuit by a large resistance, such a resistance is needed as to be able to suppress the current in a short circuit. As a result, the operating speed of the device becomes remarkably lower. Further, when the resistor is inserted at the emitter side, there is another problem that the resistor causes the loss to be increased because of a large emitter current when the device is normally operated.

There is no problem about the resistance in the case of the fuse. However, it is difficult to produce a fuse blown at a low voltage with a small current, integrally with the substrate. For example, to prevent the heat from being diffused from the fuse, the fuse needs to be positioned apart from the substrate.

In addition, there is another problem that the blocks are separated at a low speed as the opening of the fuse requires a long time.

As for the structure of inserting the MOSFET at the emitter side, when the device is normally operated, the loss caused by the FET becomes large because of a large emitter current though the loss is not so serious as that in the case of the resistor. Further, as the ability to treat a large emitter current is required of the FET, a large area is needed for the FET and thereby the packing density of the device cannot easily be increased.

The structure of inserting the MOSFET at the emitter side has an advantage of simple production as the emitter can be formed on the drain region of the MOSFET as described above. When this structure is applied to a display device the display requires a comparatively small current and, therefore, the problem of the loss caused by the FET is not so serious. Furthermore, there is an advantage that the brightness does not vary as it is determined in accordance with the characteristics of the FET.

On the other hand, in a case where the field emission device is applied to the power switching device, the loss in the MOSFET is a serious problem when the MOSFET is inserted on the emitter side. For this reason, means for maintaining the redundancy relating to a short circuit between the emitter and the gate is required in the power switching device.

BRIEF SUMMARY OF THE INVENTION

The object of the present invention is to provide a field emission device which is capable of certainly separating a short-circuited portion at a high speed without causing the lowering of the operating speed of the field emission device or the increase in the power loss, and which is thereby suitable for a power switching device.

To achieve the object, a field emission device according to a first aspect of the present invention comprises:

a casing whose interior is kept to be a vacuum;

an anode plate provided inside the casing;

an emitter plate for emitting electrons held to face the anode plate in the casing, the emitter plate being composed of a conductive plate having a plurality of field emission portions facing the anode plate, the electrons being emitted to the anode plate so that a current flows between the anode plate and the emitter plate;

a gate plate for controlling the current between the anode plate and the emitter plate, the gate plate having a plurality of openings corresponding to the plurality of field emission portions of the emitter plate, the emitter plate and the gate plate being held to be insulated from one another;

a gate voltage supply terminal for supplying a gate voltage to the gate plate; and a gate current limiting element inserted between the gate plate and the gate voltage supply terminal.

A field emission device according to a second aspect of the invention comprises:

a casing whose interior is kept to be a vacuum;

an anode plate provided inside the casing;

an emitter plate for emitting electrons held to face the anode plate in the casing, the emitter plate being composed of a conductive plate having a plurality of field emission portions facing the anode plate, the electrons being emitted to the anode plate so that a current flows between the anode plate and the emitter plate;

a gate plate for controlling the current between the anode plate and the emitter plate, the gate plate being made of a first conductivity type semiconductor having a plurality of openings corresponding to the plurality of field emission portions of the emitter plate, the emitter plate and the gate plate being held to be insulated from one another;

a second conductivity type semiconductor layer arranged around the plurality of opening portions of the gate plate, separately from the emitter;

a gate voltage supply terminal for supplying a gate voltage to the gate plate; and a gate current limiting element inserted between the gate plate and the gate voltage supply terminal.

A reverse bias is applied between the first conductivity type gate plate and the second conductivity type semiconductor layer.

The first conductivity type is preferably an n-type and the second conductivity type is a p-type.

The field emission device according to the first and second aspects is preferably constituted as follows.

The gate current limiting element is composed of an active element for limiting a current when a short circuit occurs between the emitter plate and the gate plate.

The gate plate is composed of a semiconductor material, and the active element is a junction FET integrally formed with the gate plate.

The FET is integrally formed with the gate plate in the same layer.

The FET has a gate, a source and a drain, the drain is connected to the gate voltage terminal, and the gate and the source are both connected to the gate plate.

The active element is a MOSFET integrally formed with the gate plate.

The MOSFET is integrally formed with the gate plate in the same layer.

The MOSFET has a gate, a source and a drain, the drain is connected to the gate voltage terminal, and the gate and the source are both connected to the gate plate.

The gate plate is divided into a plurality of blocks and each of the plurality of blocks has the current limiting element.

The device is a power switching device.

The field emission device of the present invention comprises a current limiting element for electrically separating the blocks including the device where a short circuit occurs between the gate and the emitter, on the gate side to which only a small current flows in the normal operation. For this reason, the loss in the normal operation is so small that it can be neglected, and the current limiting element does not have to have an ability to treat a large current. Lowering of the operating speed of the field emission device in the normal operation can be made smaller as compared with a case where a resistor is used. Further, the current limiting element can easily be produced integrally with the field emission element by the conventional semiconductor manufacturing technique.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 2A to 2C are diagrams explaining a measure with respect to the gate-emitter short circuit in the conventional field emission device, FIG. 2A illustrates an example that an emitter layer comprises a high resistance layer, FIG. 2B illustrates an example of using a high resistance gate and FIG. 2C illustrates an example of using a fuse;

FIG. 3 is a diagram explaining another measure with respect to the gate-emitter short circuit in the conventional field emission device, illustrating an example of connecting a MOSFET to the emitter of the field emission device;

DETAILED DESCRIPTION OF THE INVENTION

The embodiments of the present invention will be explained below with reference to the drawings.

(First Embodiment)

Figure 1A:
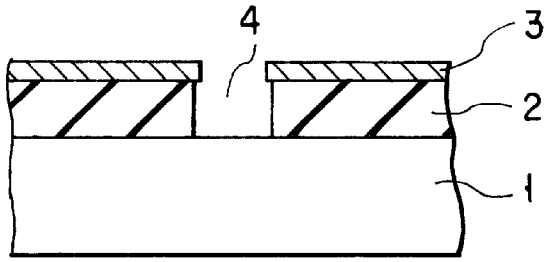
FIG. 1A PRIOR ART
FIGS. 1A to 1D are sectional views showing the steps of a method of manufacturing a conventional field emission device.
Figure 1B:
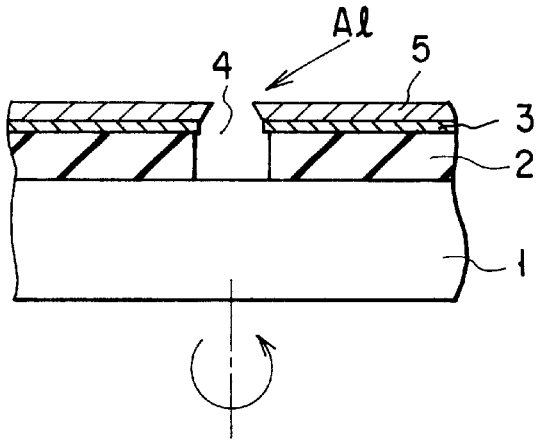
FIG. 1B PRIOR ART
Figure 1C:
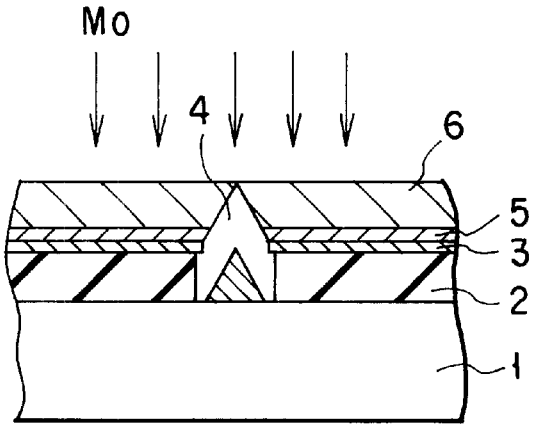
FIG. 1C PRIOR ART
Figure 1D:
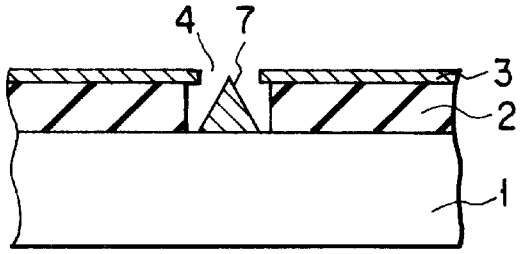
FIG. 1D PRIOR ART
Figure 4:
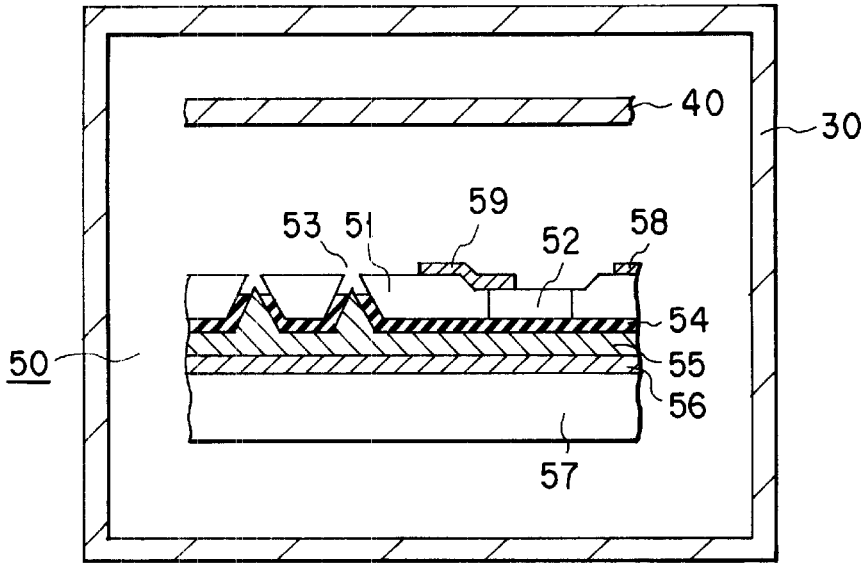
FIG. 4 is a sectional view schematically showing a field emission device according to a first embodiment of the present invention.
Figure 5:
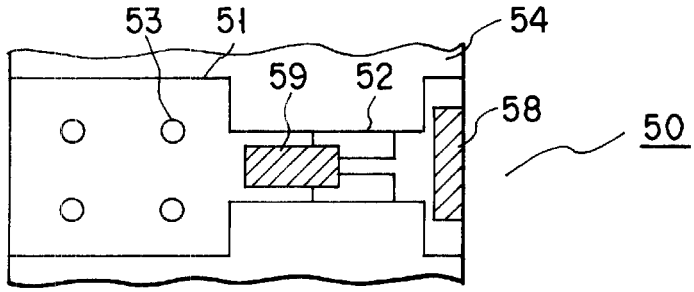
FIG. 5 is a plan view showing a field emission structure of FIG. 1.

FIG. 4 is a sectional view schematically showing a field emission device according to a first embodiment of the present invention. A field emission structure 50 and an anode 40 are held to face each other in a casing 30 whose interior is kept to be vacuum. FIG. 5 is a plan view of the field emission structure as seen from the anode side in FIG. 4.

Figure 6:
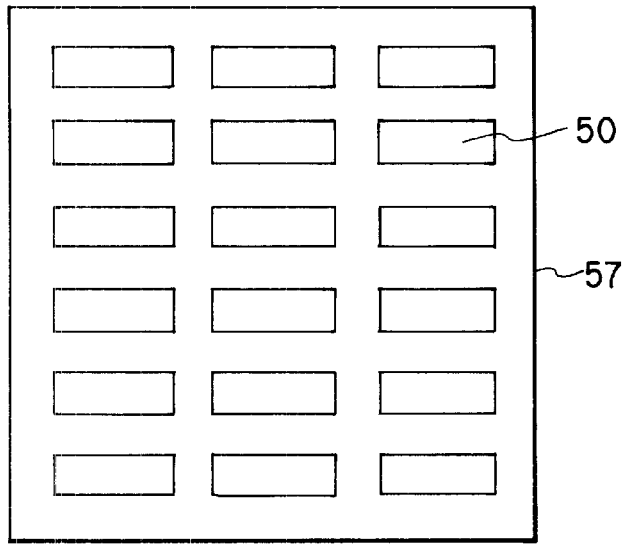
FIG. 6 is a plan view schematically showing that the field emission structures of the first embodiment are arranged in an array.

The figures illustrate one block of the field emission structure 50 for easy understanding, but in fact a number of field emission structures 50 are electrically aligned as shown in FIG. 6. Detailed illustration of the field emission structures is omitted in FIG. 6. The target of the present invention is a power switching device capable of handling a current of approximately 100 A. The number of emitter protruding portions (described later) of the field emission structure reaches about $10^7$ to $10^8$.

The field emission structure 50 is constituted a field emission element and a current limiting element as described below. An emitter layer 55 formed of Mo or the like is mounted on an upper surface of a glass substrate 57 through an adhesive layer 56. A plurality of protruding portions are formed on the emitter layer 55.

An n-type region 51 is formed on the emitter layer 55 through a thermal oxide film 54. A plurality of openings are provided in the n-type region 51, on an upper left part of the emitter layer 55, to correspond to the emitter protruding portions, and serve as gate portions. Two insular regions 52 facing one another are formed in the n-type region 51, on an upper right part of the emitter layer 55, serving as junction FETs together with the n-type region surrounding them. Reference numerals 58 and 59 denote electrodes of the junction FETs.

Thus, in the field emission device of the present invention, a field emission element is constituted by each emitter protruding portion and the opening of the gate portion corresponding thereto. A junction FET serving as the current limiting element is connected to the gates of a plurality of field emission elements connected in parallel.

One field emission element has a current amount of about 1 to 10 $\mu$A, and a number of field emission elements need to be connected in parallel in order to handle a large current by the field emission device. To completely avoid the influence of a short circuit of the field emission elements, it is ideal to connect the current limiting element to each of the field emission elements, but this is not economically realistic. For this reason, the current limiting element is provided for a plurality of field emission elements.

Next, a method of producing the above-described field emission device will be explained with reference to FIGS. 7A, 7B to 11A, 11B. The drawings with suffix B are sectional views as seen along a line designated in the plan views having suffix A.

Figure 7A:
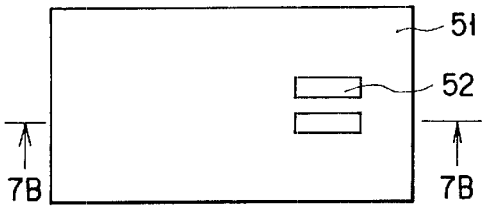
FIGS. 7A, 7B, 8A, 8B, 9A, 9B, 10A, 10B, 11A and 11B are sectional views showing the steps of a method of manufacturing the field emission structure according to the first embodiment.
Figure 7B:
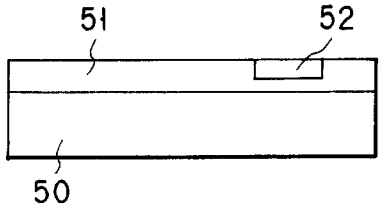

First, the p-type Si-substrate 51 of (100) crystal orientation is prepared as shown in FIGS. 7A and 7B, and the n-type region 51 is formed by the ion implantation. Illustration of the entire body of the substrate 50 is omitted in the figures, and the only n-type region 51 is shown.

Next, a mask for ion implantation (not shown) is formed by forming a thermal oxide film (not shown) and patterning the film. The p-type regions 52 that are shallower in depth than the n-type region 51 are formed by ion implantation using this mask. The p-type regions 52 are two insular regions separated by a small gap.

Figure 8A:
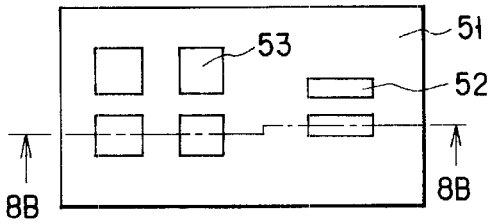
Figure 8B:
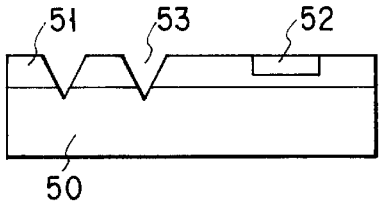

After a thermal oxide film (not shown) has been formed again, the film is patterned and to form a mask (not shown) having a square-shaped opening portion. After that, a recess portion 53 that penetrates the n-type region 51 and has a cone-shaped bottom is formed by anisotropic etching using a KOH solution, so that the unnecessary mask is removed (FIGS. 8A and 8B).

Figure 9A:
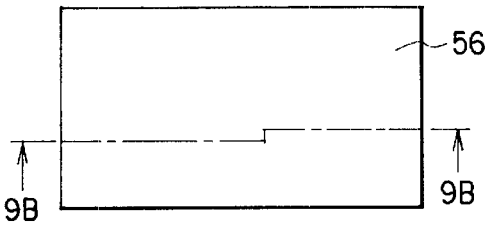
Figure 9B:
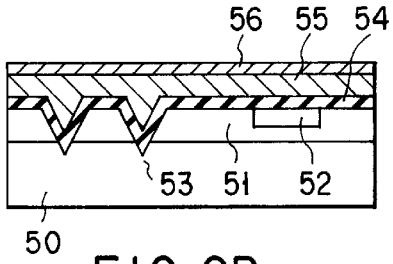

After the thermal oxide film 54 has been formed as shown in FIGS. 9A and 9B, the emitter layer 55 is formed by, for example, sputtering Mo. Next, the adhesive layer 56 is formed by, for example, sputtering Al, for the electrostatic bonding that is to be executed in the following step.

Figure 10A:
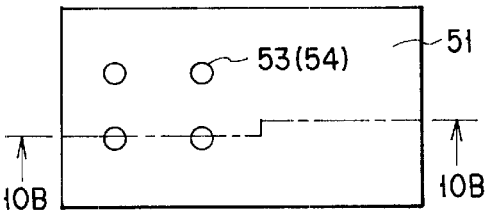
Figure 10B:
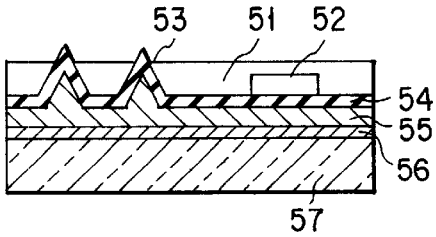

The adhesive layer 56 and the glass substrate 57 are bonded by the electrostatic bonding as shown in FIGS. 10A and 10B. It should be noted that the vertical direction of the device is turned up side down in these figures. The electrostatic bonding is executed by applying a high voltage between the adhesive layer 56 and the glass substrate 57 at a high temperature while the adhesive layer 56 is at an electrically positive side. Next, while leaving the n-type region 51 including the p-type region 52, the p-type Si-substrate 50 is removed by the electrochemical etching. Thus, a portion near the pyramidal peak of the thermal oxide film is exposed. The portion near the pyramidal peak is similar to a cone, and the opening 53 becomes therefore a square having the rounded corners as shown in FIG. 10A.

The electrochemical etching is a method of selectively etching only the p-type portion in the KOH solution while applying a reverse bias to the pn-junction in the Si-substrate. In the present embodiment, the electrochemical etching is executed by applying a reverse bias between the p-type portion of the Si-substrate 50 and the n-type region 51.

Figure 11A:
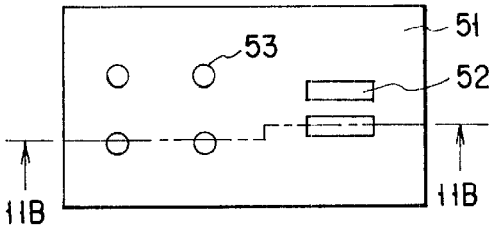
Figure 11B:
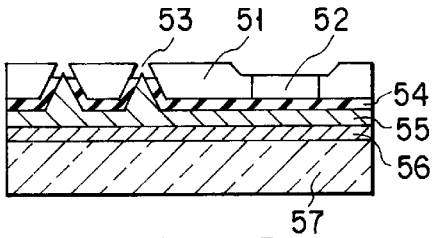

After a part of the n-type region covering the p-type region 52 has been removed by dry etching, the thermal oxide film 54 near the peak portion of the emitter is selectively etched in an $NH_4$/HF-mixture solution, as shown in FIGS. 11A and 11B.

Next, after the n-type region 51 is patterned to form the current limiting element portion, the electrodes 58 and 59 for power supply are formed by forming and patterning the Al layer for electrodes, and thereby the field emission structure is completed as indicated by reference numeral 50 in FIG. 4 and as shown in FIG. 5.

The above figures illustrate only four opening portions of the gate electrode. However, the number of the opening portions is set arbitrarily and in fact a large number of opening portions are formed. As for the field emission device, a large number of such blocks are formed.

Next, the operation of this device will be explained with reference to FIGS. 12 and 13. A portion sandwiched between two insular p-type regions 52 in FIG. 5 forms what is called a junction FET (J FET). A source electrode and a gate electrode of the J FET are short-circuited by the electrode 59.

Figure 12:
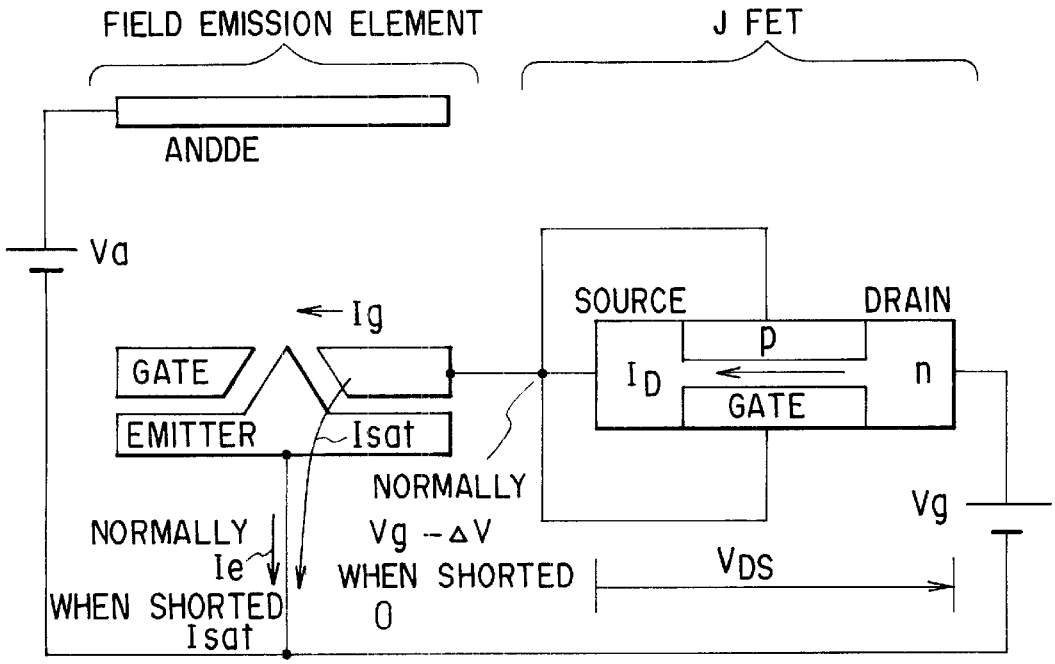
FIG. 12 is a diagram explaining the operations of the field emission device according to the first embodiment.
Figure 13:
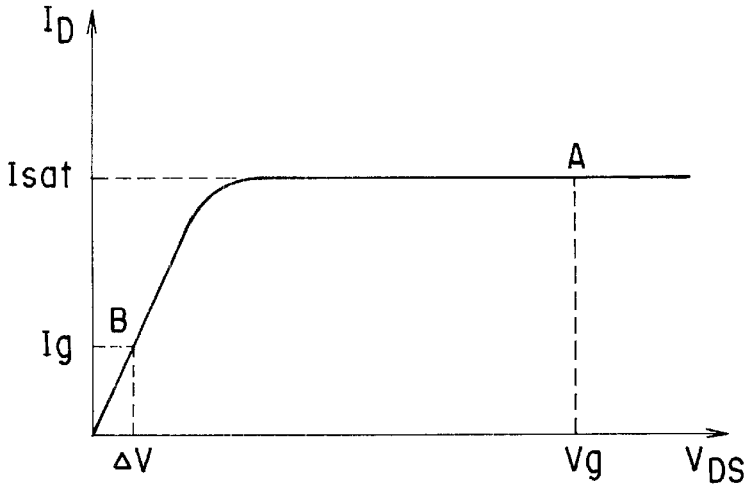
FIG. 13 is a diagram explaining the junction FET characteristics and the operating point used in the first embodiment.

The current-voltage characteristics of such a J FET are illustrated in FIG. 12. In the figure, $I_D$ indicates a drain current of the J FET and $V_{DS}$ indicates a drain-source voltage of the J FET.

The electric potential of the drain is equivalent to supply voltage Vg, and the source potential is zero in a short circuit between the emitter and the gate. Therefore, the operating point is point A in FIG. 12 where saturation current $I_{sat}$ flows. In the normal operation, as a tiny part of emitter current $I_e$ flows as the gate current Ig, the operating point is point B in this figure and the source potential is slightly lowered from Vg by ΔV.

The saturation current $I_{sat}$ can be made smaller by shortening the gap between the p-type regions 52 and making the length in the flowing direction of the current larger, and thereby the short-circuited block can be electrically separated. The gate electrode of the J FET may be separated from the source electrode and the negative potential may be applied to the gate electrode. In this case, however, a new power supply is required and the leading-out of the gate electrode becomes difficult.

Figure 14:
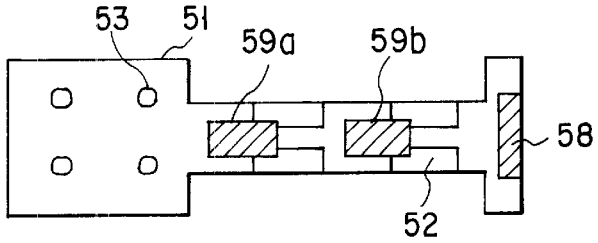
FIG. 14 is a plan view showing the field emission structure, illustrating an example of using the junction FETs at two stages in the first embodiment.

In the present embodiment, the power loss at the FET is Ig~ΔV and Ig<<Ie, in the normal operation. Therefore, the loss can be reduced as compared with a case where the FET is inserted into the emitter. In addition, a value of an equivalent resistance is the order of ΔV/Ig in the normal operation and the order of $Vg/I_{sat}$ at the time of occurrence of a short circuit. It is understood that the operating speed of the device becomes higher than that in a case of using the pure resistance, from the fact that $\Delta V/Ig \ll Vg/I_{sat}$ and that the equivalent resistance value in the normal operation is smaller than that at occurrence of a short circuit. If Vg is so high that the withstanding voltage of the J FET is insufficient, the J FETs may be mounted at two stages or more as shown in FIG. 14. In FIG. 14, reference numerals 59*a* and 59*b* denote electrodes.

In the first embodiment, a protruding portion is formed on the emitter plate as a field emission portion. However, the field emission portion may be formed flat if the field emission portion is formed by a material having a low work function. This also applies to the second and third embodiments described hereinafter.

(Second Embodiment)

Figure 15A:
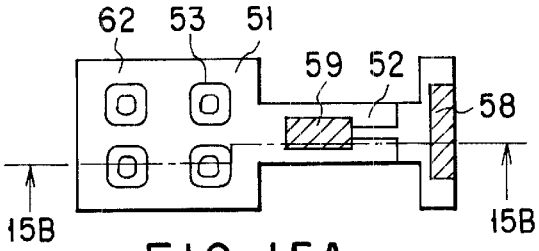
FIGS. 15A and 15B are a plan view and a sectional view, respectively, showing a field emission structure according to a second embodiment of the present invention.
Figure 15B:
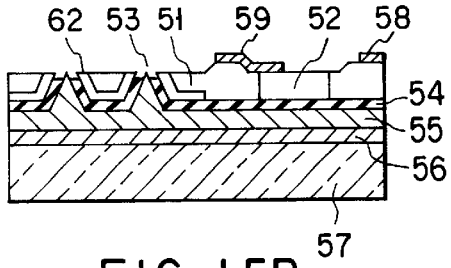

FIGS. 15A and 15B are a plan view and a sectional view, respectively, showing the field emission structure according to a second embodiment of the present invention. In the second embodiment, an example that the reverse-biased pn-junction (i.e. the pn-junction formed of the n-type region 51 and the p-type region 62) which hardly causes a current to flow exists at the gate portion surrounding the emitter 55 to further improve the redundancy for a short circuit between the emitter and the gate, will be explained. The basic structure of the field emission device in FIG. 4 and the array alignment of the field emission portions in FIG. 6 as explained in the first embodiment are also applied to the second and third embodiments though not shown again.

FIGS. 16A, 16B to 20A, 20B illustrate the steps of the method of manufacturing the field emission device (structure) according to the second embodiment. The same constituent portions as those of the first embodiment are denoted by the same reference numerals and their detailed explanation is omitted.

Figure 16A:
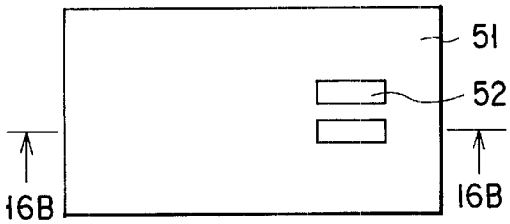
FIGS. 16A, 16B, 17A, 17B, 18A, 18B, 19A, 19B, 20A and 20B are diagrams showing the steps of a method of manufacturing the field emission structure according to the second embodiment.
Figure 16B:
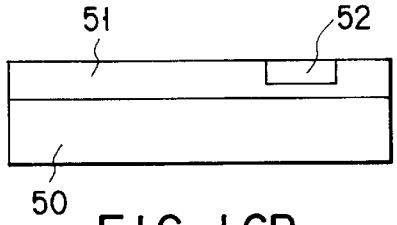
Figure 17A:
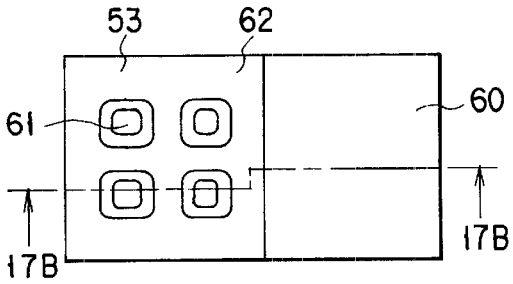
Figure 17B:
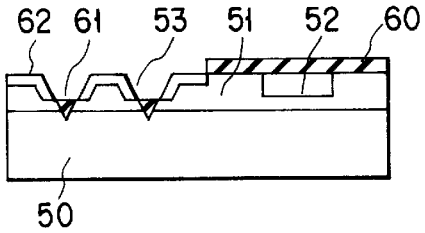
Figure 18A:
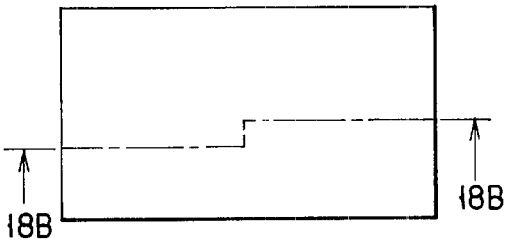
Figure 18B:
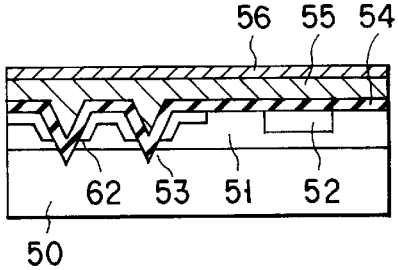

First, the n-type region 51 is formed on the p-type silicon substrate 50 and the p-type region 52 is formed on the n-type region 51 in the same manner as the first embodiment (FIGS. 16A and 16B). After the recess portion 53 is formed by the anisotropic etching in the same manner as the first embodiment, the thermal oxide film is formed, patterning is executed and a thermal oxide layer 60 which is to serve as a mask for ion implantation is formed in the junction FET portion. A resist is subjected to the spin coating and the etching back, a resist 61 is left at the only bottom part of the recess portion 53, and a p-type region 62 is formed by using the resist 61 as a mask for the ion implantation (FIGS. 17A, 17B).

Figure 19A:
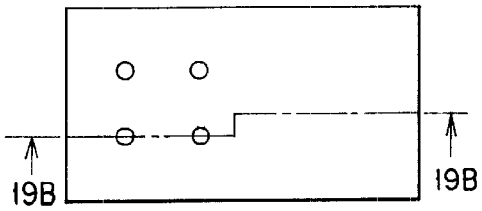
Figure 19B:
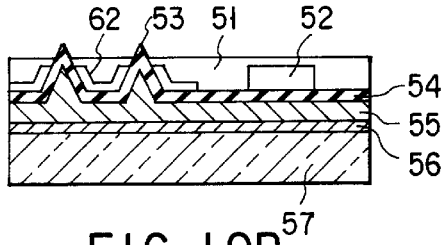

Next, after the thermal oxide film 54 is formed, for example, the emitter layer 55 is formed by sputtering Mo and the adhesive layer 56 is further formed on the emitter layer 55 by, for example, sputtering Al. Next, the adhesive layer 56 and the glass substrate 57 are bonded by the electrostatic bonding as shown in FIGS. 19A and 19B. It should be noted that the device is illustrated upside down in these drawings. The p-type Si-substrate 50 is removed by the electrochemical etching while the n-type region 51 including the p-type region 52 is left.

Figure 20A:
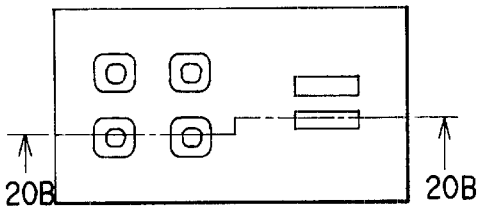
Figure 20B:
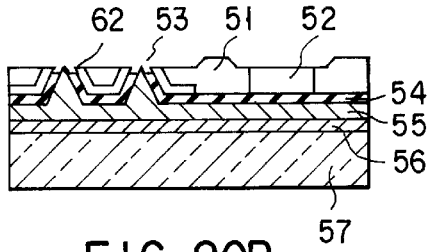

Subsequently, the n-type region 51 covering the p-type region 62 is selectively removed by the dryetching in addition to the n-type region 51 covering the p-type region 52, as shown in FIGS. 20A and 20B. The succeeding process steps are executed in the same manner as the first embodiment, and the field emission device shown in FIGS. 15A and 15B is thereby completed.

In the second embodiment, the reverse-biased pn-junction that does not allow the current to easily pass therethrough exists at the gate portion surrounding the emitter and thus the redundancy for a short circuit between the emitter and the gate is further improved.

(Third Embodiment)

Figure 21A:
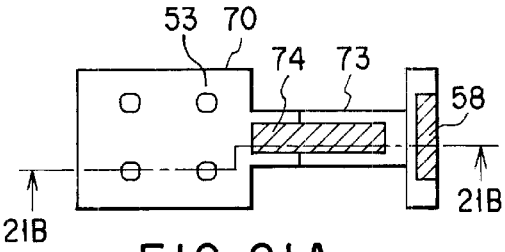
FIGS. 21A and 21B are a plan view and a sectional view, respectively, showing a field emission structure according to a third embodiment of the present invention.
Figure 21B:
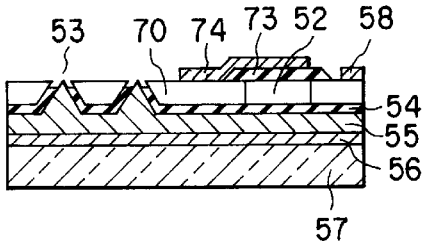

FIGS. 21A and 21B are a plan view and a sectional view, respectively, showing the field emission structure according to the third embodiment of the present invention. In the third embodiment, an example of using the MOSFET in place of the J FET of the first embodiment as the active element (current limiting element) will be explained.

FIGS. 22A, 22B to 26A, 26B illustrate the steps of manufacturing the field emission device according to third embodiment. The same constituent portions as those of the first embodiment are denoted by the same reference numerals and their detailed explanation is omitted.

Figure 22A:
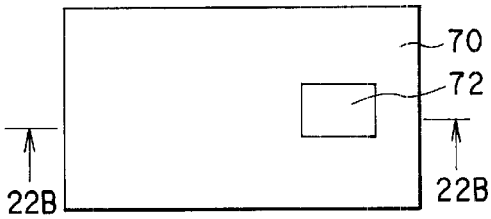
FIGS. 22A, 22B, 23A, 23B, 24A, 24B, 25A, 25B, 26A and 26B are diagrams showing the steps of a method of manufacturing the field emission structure according to the third embodiment.
Figure 22B:
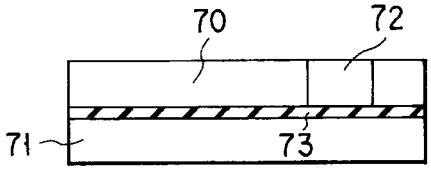

First, an SOI-substrate 71 having an n-type Si-layer 70 of (100) crystalline orientation is prepared as shown in FIGS. 22A and 22B. Reference numeral 73 denotes an SOI-insulation film. A p-type region 72 is formed by the ion implantation.

Figure 23A:
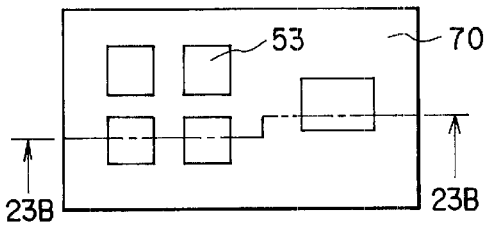
Figure 23B:
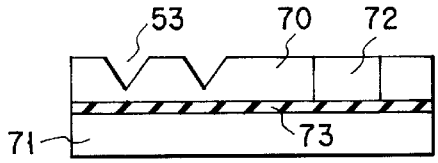

Next, the recess portion 53 is formed by the anisotropic etching as shown in FIGS. 23A and 23B.

Figure 24A:
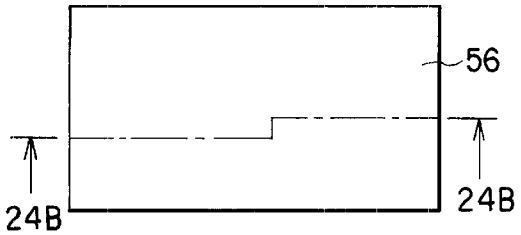
Figure 24B:
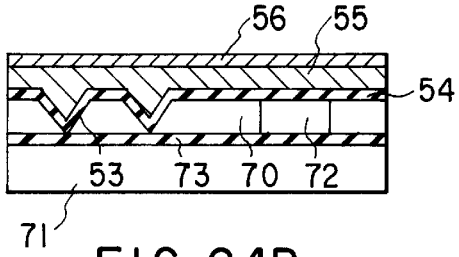

The thermal oxide film 54 is formed to abut on the SOI oxide layer 73 as shown in FIGS. 24A and 24B. Then, the emitter layer 55 and the adhesive layer 56 are formed in the same manner as the first embodiment.

Figure 25A:
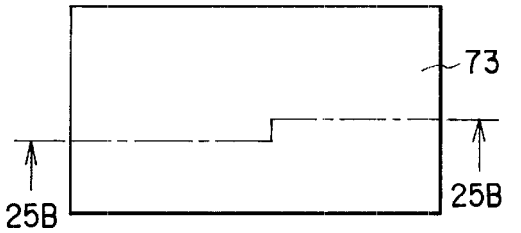
Figure 25B:
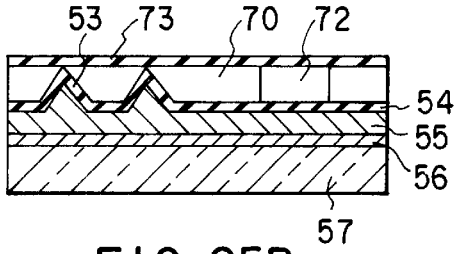

Next, the adhesive layer 56 and the glass substrate 57 are bonded by the electrostatic bonding as shown in FIGS. 25A and 25B. It should be noted that the device is illustrated upside down in these drawings. The SOI substrate is etched. The etching is stopped by the oxide layer 73 of the SOI substrate.

Figure 26A:
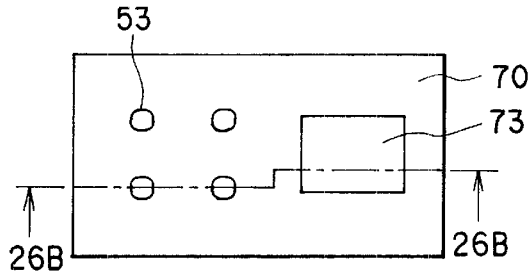
Figure 26B:
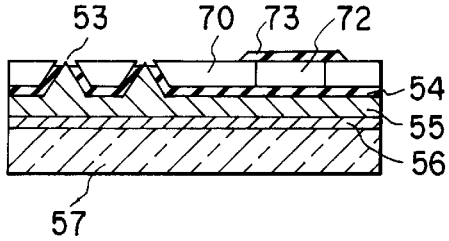

The oxide layer 73 of the SOI substrate is removed by etching while a part thereof is left, as shown in FIGS. 26A and 26B. The thermal oxide film 54 near the top end of the emitter is also removed in this step.

After the n-type region 70 and the p-type region 72 are patterned, the AL layer for the electrode is formed and patterned to form the electrodes 58 and 74, and thus the device is completed (FIGS. 21A and 21B). A number of such blocks are formed in an actual device.

Figure 27A:
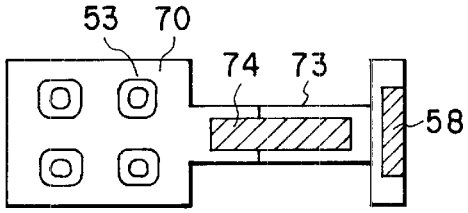
FIGS. 27A and 27B are a plan view and a sectional view, respectively, showing a modified example of the third embodiment.
Figure 27B:
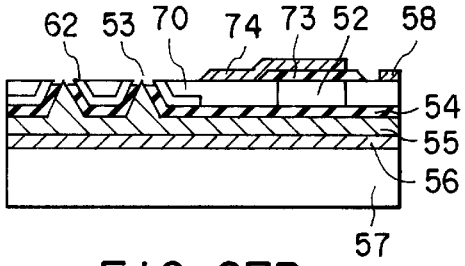

In the third embodiment, the MOSFET is used in place of the J FET of the first embodiment as the active element (current limiting element), and the same advantage can be obtained. The MOSFET of the third embodiment can be also combined with the field emission element of the second embodiment including the pn-reverse junction in the gate portion, as shown in FIGS. 27A and 27B.

In the first to third embodiments, the glass substrate 57 is used since the bonding of the substrate 57 to the adhesive layer 56 is executed by the electrostatic bonding. When another bonding method is applied, another kind of substrate can be used.

In the field emission device of the present invention, the element for electrically separating the field emission element blocks where a gap between the gate and the emitter is short-circuited is provided at the gate side to which only a small current flows in the normal operation. Therefore, the power loss in the normal operation is so small that it can be neglected, and an ability to treat a large current is not required for the separating element. Additionally, the lowering of the operating speed of the field emission device in the normal operation can be made smaller as compared with that in a case where the resistor is used. Further, the element for electrically separating a short-circuited blocks can easily be manufactured integrally with the field emission element by the conventional semiconductor manufacturing technique.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A field emission device comprising:

a casing whose interior is kept to be a vacuum;

an anode plate provided inside said casing;

an emitter plate for emitting electrons held to face said anode plate in said casing, said emitter plate being composed of a conductive plate having a plurality of field emission portions facing said anode plate, said electrons being emitted to said anode plate so that a current flows between said anode plate and said emitter plate;

a gate plate for controlling said current between said anode plate and said emitter plate, said gate plate having a plurality of openings corresponding to said plurality of field emission portions of said emitter plate, said emitter plate and said gate plate being held to be insulated from one another;

a gate voltage supply terminal for supplying a gate voltage to said gate plate; and a gate current limiting element inserted between said gate plate and said gate voltage supply terminal.

2. The field emission device according to claim 1, wherein said gate current limiting element is composed of an active element for limiting a current when a short circuit occurs between said emitter plate and said gate plate.

3. The field emission device according to claim 2, wherein said active element is a MOSFET integrally formed with said gate plate.

4. The field emission device according to claim 3, wherein said MOSFET is integrally formed with said gate plate in the same layer.

5. The field emission device according to claim 3, wherein said MOSFET has a gate, a source and a drain, said drain is connected to said gate voltage terminal, and said gate and said source are both connected to said gate plate.

6. The field emission device according to claim 1, wherein said gate plate is composed of a semiconductor material, and said active element is a junction FET integrally formed with said gate plate.

7. The field emission device according to claim 6, wherein said FET is integrally formed with said gate plate in the same layer.

8. The field emission device according to claim 6, wherein said FET has a gate, a source and a drain, said drain is connected to said gate voltage terminal, and said gate and said source are both connected to said gate plate.

9. The field emission device according to claim 1, wherein said gate plate is divided into a plurality of blocks and each of said plurality of blocks has said current limiting element.

10. The field emission device according to claim 1, wherein said device is a power switching device.

11. A field emission device comprising:

a casing whose interior is kept to be a vacuum;

an anode plate provided inside said casing;

an emitter plate for emitting electrons held to face said anode plate in said casing, said emitter plate being composed of a conductive plate having a plurality of field emission portions facing said anode plate, said electrons being emitted to said anode plate so that a current flows between said anode plate and said emitter plate;

a gate plate for controlling said current between said anode plate and said emitter plate, said gate plate being made of a first conductivity type semiconductor having a plurality of openings corresponding to said plurality of field emission portions of said emitter plate, said emitter plate and said gate plate being held to be insulated from one another;

a second conductivity type semiconductor layer arranged around said plurality of opening portions of said gate plate, separately from said emitter;

a gate voltage supply terminal for supplying a gate voltage to said gate plate; and a gate current limiting element inserted between said gate plate and said gate voltage supply terminal.

12. The field emission device according to claim 11, wherein a reverse bias is applied between said first conductivity type gate plate and said second conductivity type semiconductor layer.

13. The field emission device according to claim 11, wherein said gate current limiting element is composed of an active element for limiting a current when a short circuit occurs between said emitter plate and said gate plate.

d14. The field emission device according to claim 13, wherein said gate plate is composed of a semiconductor material, and said active element is a junction FET integrally formed with said gate plate.

15. The field emission device according to claim 14, wherein said FET is integrally formed with said gate plate in the same layer.

16. The field emission device according to claim 13, wherein said active element is a MOSFET integrally formed with said gate plate.

17. The field emission device according to claim 16, wherein said MOSFET is integrally formed with said gate plate in the same layer.

18. The field emission device according to claim 16, wherein said MOSFET has a gate, a source and a drain, said drain is connected to said gate voltage terminal, and said gate and said source are both connected to said gate plate.

19. The field emission device according to claim 14, wherein said FET has a gate, a source and a drain, said drain is connected to said gate voltage terminal, and said gate and said source are both connected to said gate plate.

20. The field emission device according to claim 11, wherein said gate plate is divided into a plurality of blocks and each of said plurality of blocks has said current limiting element.

21. The field emission device according to claim 11, wherein said first conductivity type is an n-type and said second conductivity type is a p-type.

22. The field emission device according to claim 11, wherein said device is a power switching device.

* * * * *